US005868598A

United States Patent [19]

Dinovo

[11] Patent Number: 5,868,598

[45] Date of Patent: Feb. 9, 1999

[54] BOW DISPLAY, STORAGE AND HOOP SUBSTITUTE DEVICE FOR A DOLL'S SKIRT

[76] Inventor: Bonnie M. Dinovo, 216 West Joliet Hwy., New Lenox, Ill. 60451

[21] Appl. No.: 662,047

[22] Filed: Jun. 12, 1996

[51] Int. Cl.[6] ..... A63H 3/52

[52] U.S. Cl. ..... 446/73; 446/268

[58] Field of Search ..... 446/72–75, 268; 206/457; 139/387–389; 224/660, 664, 662; 383/41

[56] References Cited

U.S. PATENT DOCUMENTS

| | | | |
|---|---|---|---|
| 1,390,667 | 9/1921 | Bonestell | 446/73 X |
| 1,407,165 | 2/1922 | Pajeau | 446/74 |
| 4,782,950 | 11/1988 | Santoro | 446/73 X |
| 5,456,062 | 10/1995 | Wechsler | 383/41 X |

FOREIGN PATENT DOCUMENTS

| | | | |
|---|---|---|---|
| 1183630 | 9/1960 | France | 446/73 |
| 2110549 | 6/1983 | United Kingdom | 446/72 |

*Primary Examiner*—Robert A. Hafer
*Assistant Examiner*—Jeffrey D. Carlson
*Attorney, Agent, or Firm*—Cherskov & Flaynik

[57] ABSTRACT

A bow storage and hoop substitute device 10 for a doll's skirt 20 includes a tubular member 14 having open lateral sides 34 for inserting a predetermined quantity of bow 18 into the member 14, the tubular member 14 being secured to a doll's waist 28 via a drawstring 12 interwoven with a first edge 17 of two-plys of net material used to fabricate the member 14, the tubular member 14 including a second edge 19 sized in conjunction with the lateral sides 34 to provide the tubular member 14 a hoop characteristic having a diameter corresponding to a desired configuration for the doll's shirt 20.

17 Claims, 4 Drawing Sheets

BOW DISPLAY, STORAGE AND HOOP SUBSTITUTE DEVICE FOR A DOLL'S SKIRT

BACKGROUND OF THE INVENTION

1. Filed of the Invention

The present invention relates to a bow display, storage and hoop substitute device for a doll's skirt, and more particularly, to a device used to store bows from bridal shower and wedding gifts and substitute as a hoop to expand a bride doll's wedding skirt.

2. Background of the Prior Art

It is traditional for a soon-to-be bride to save bows attached to gifts given to her at her bridal shower and wedding. The problem that the future bride faces is where to store the bows. One method of storing the bows is under the bride doll's wedding skirt.

Prior art designs, as disclosed in Bridal Crafts magazine, January, 1996, pages 33–36, utilize a circular cardboard base with a small orifice at the center. The base is set on a planar surface, the doll's feet are positioned in the orifice, a slip attached to the dolls waist is glued to the edge of the orifice. Next, a skirt made from lace material is attached to the doll's waist, then glued around the perimeter of the cardboard base except for a small opening to insert the bows therein. Once the bows have been placed within the chamber the lace perimeter is completely glued to the cardboard base. Thus, the lace and cardboard form the doll's skirt and a bow storage chamber that allows the box to be viewed.

The problem with the aforementioned design is that it is very difficult to remove the bows. One must detach the lace at the dolls waist to get to the bows. Further, one must "guess" at the cardboard base diameter which is dependent upon the quantity of bows that need to be stored. If the base diameter is to small, the storage chamber will not accept all the bows. If the base diameter is to large, there won't be enough bows to fill the chamber thereby allowing the lace material and skirt to "sag" on the doll. This "sag" diminishes the hoop skirt characteristic that provides elegance to the doll's skirt.

Other prior art doll accessories are disclosed in U.S. Pat. Nos. 5,433,643; 5,040,679; and 4,749,088; however, these patents do not teach one how to store bows under a bridal doll's wedding dress.

A need exists in the art for a bow storage device that is inexpensive, easily attaches to a bridal doll, provides for easy insertion and removal of bows from the device, and is hidden under the skirt yet lifts the skirt outward without using a base thereby presenting a hoop skirt characteristic.

SUMMARY OF THE INVENTION

An object of the present invention is to provide a bow storage device and hoop substitute for a doll's skirt that overcomes all of the disadvantages of the prior art.

It is another object of the present invention to simplify attaching the bow storage device to the doll. A feature of the device is to use a draw string to cinch the device about the doll's waist. An advantage of the device is the elimination of a cardboard base.

Yet another object of the present invention is to provide easy insertion and removal of bows from the device. A feature of the device is a means for quick access to the device. An advantage of the device is that the bows may be removed without damage to the device.

Other objects are to reduce the number of components to build a bow storage and hoop substitute device; to reduce the costs to construct a bow storage and hoop substitute device; to allow easy insertion and removal of bows from a bow storage and hoop substitute device; to provide a bow storage and hoop substitute device that easily attaches to a bridal doll; to provide a bow storage and hoop substitute device that is hidden under a bridal doll's skirt and lifts the skirt outward without using a base thereby presenting a hoop skirt characteristic; and to provide an apparatus for bow storage and hoop substitute for a bridal doll's skirt.

The present invention provides a device for bow storage and hoop substitute for a skirt for a human form comprising a member fabricated from a quasi rigid material formed into a configuration with open lateral sides and with a means for attaching said member circumferentially at the mid-section position of the human form, said open lateral sides of said member allowing items to be stored in said member from either lateral side thereby expanding said member to a predetermined expanded position corresponding to an expanded position of said skirt when attached to said human form.

BRIEF DESCRIPTION OF THE DRAWINGS

These and other objects, advantages and novel feature of the present invention, as well as details of an illustrative embodiment thereof, will be more fully understood from the following detailed description and attached drawings, wherein.

DESCRIPTION OF THE PREFERRED EMBODIMENT

Figure 1:
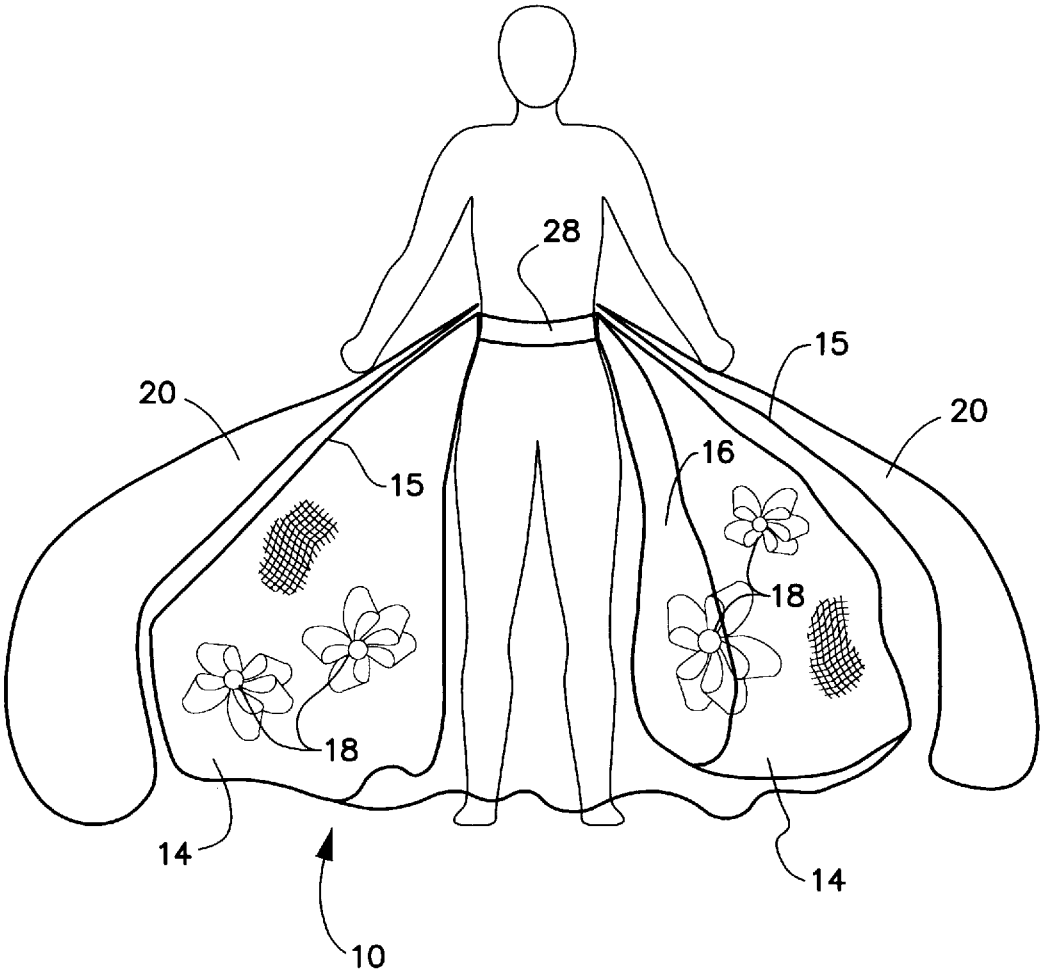
FIG. 1 is a back elevation view of a bow display, storage and hoop substitute device for a doll's skirt in accordance with the invention with the device attached to a doll.
Figure 2:
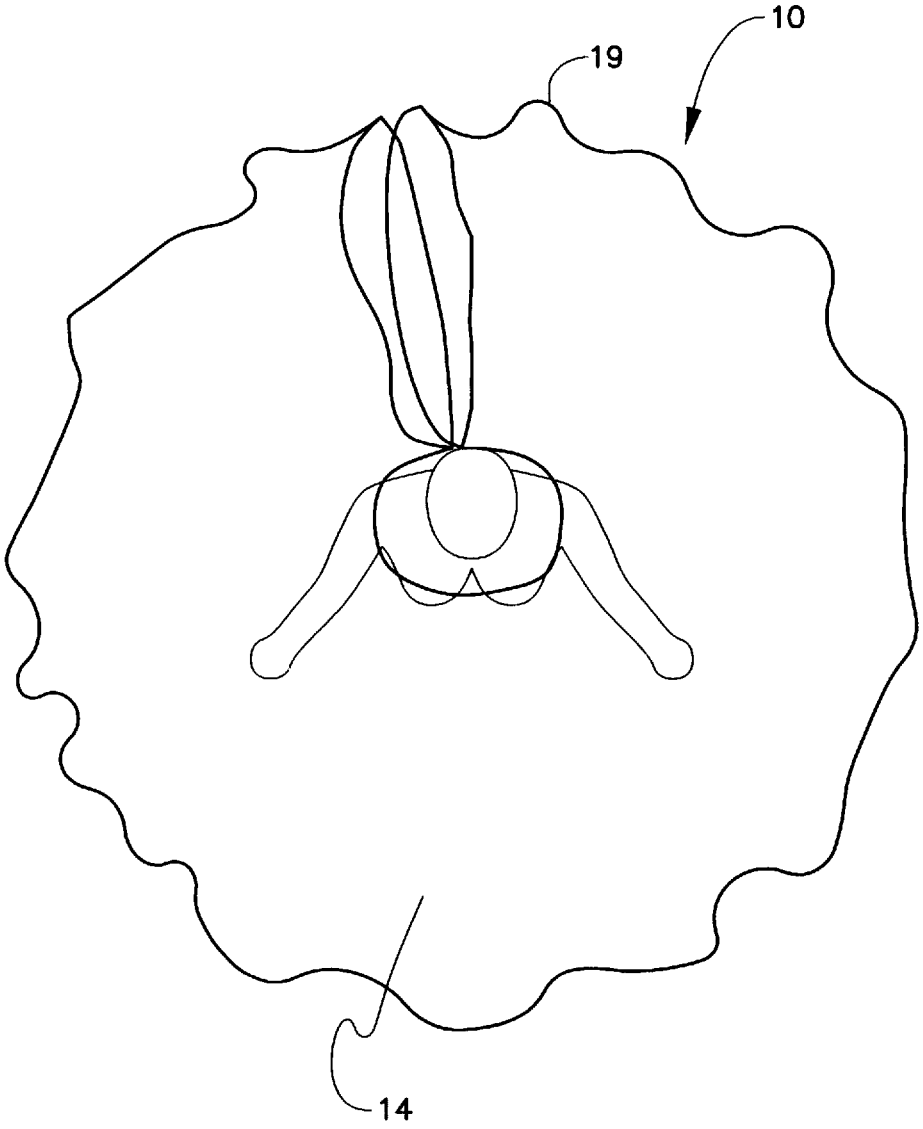
FIG. 2 is a top elevation view of a bow display, storage and hoop substitute device for a doll's skirt in accordance with the invention with the device attached to a doll.
Figure 3:
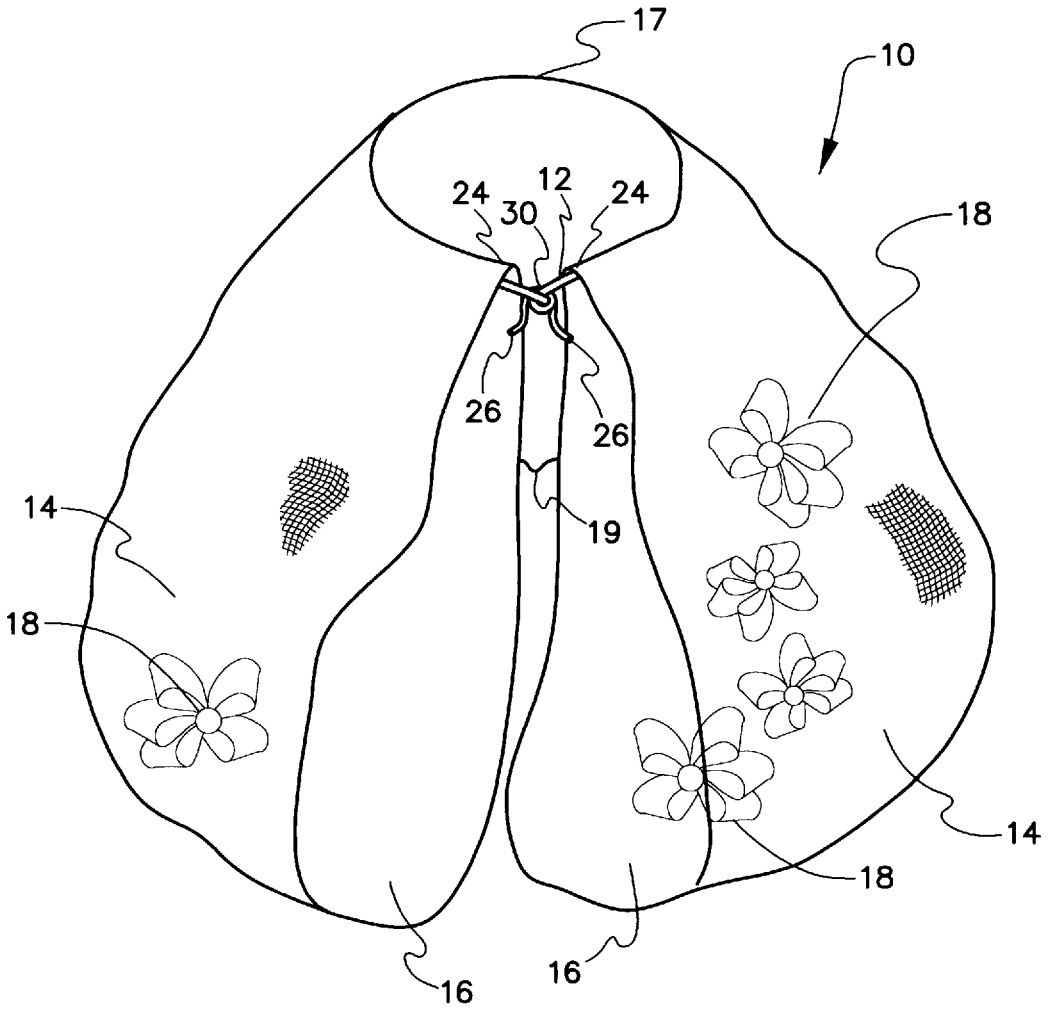
FIG. 3 is a back perspective view of a bow display, storage and hoop substitute device for a doll's skirt in accordance with the invention.

Referring now to FIGS. 1–3, a bow display, storage and hoop substitute device for a doll's skirt in accordance with this invention is denoted by numeral 10. The device includes a drawstring 12 and storage member 14 with a storage cavity 16 defined thereby.

The storage member 14 is fabricated from a two-ply, relatively rigid net material, with the two-plys secured at first and second edges 17 and 19. Utilizing a relatively rigid material, maintains a skirt support surface 15 of the storage member 14 relatively smooth even with a plurality of bows 18 placed within the member 14. The doll's skirt 20 is positioned upon the support surface 15 of the storage member 14. The smooth support surface 15 maintains the doll's skirt 20 uniform and symmetrical. Further, using a net design instead of a solid fabric allows one to view the bows 28 within the storage member 14, simply by lifting the doll's skirt 20.

Figure 4:
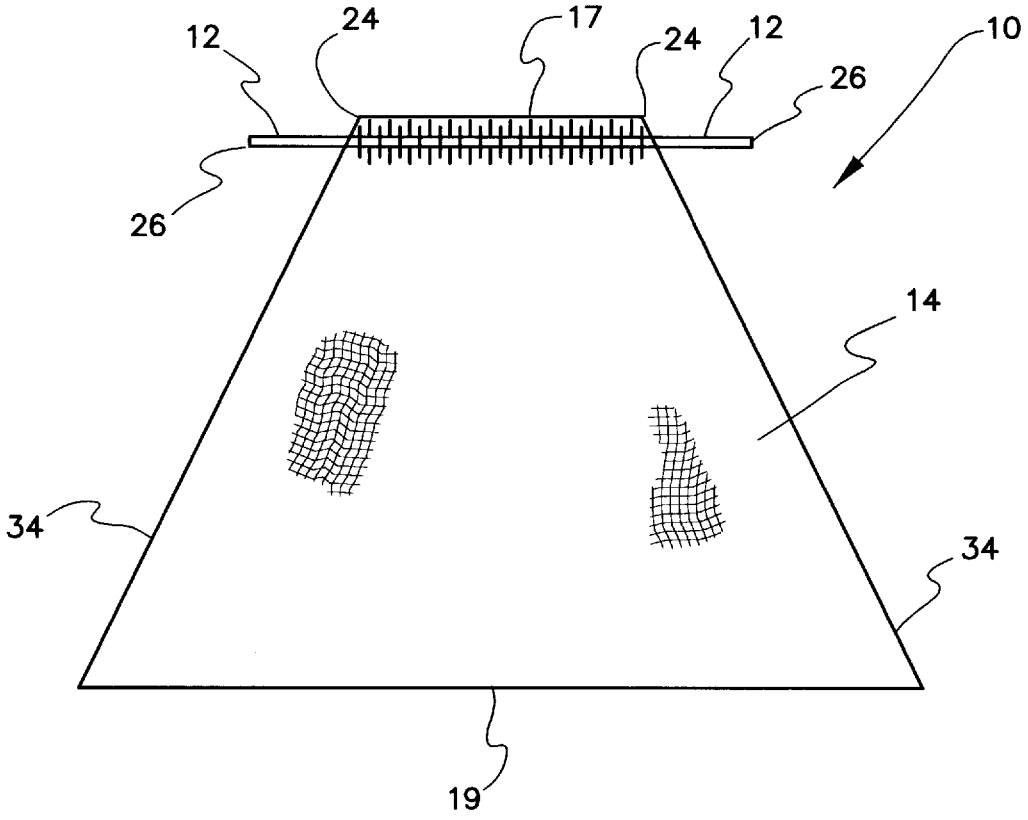
FIG. 4 is a top elevation view of a bow display, storage and hoop substitute device for a doll's skirt in accordance with the invention with the device laid flat on a planar surface.

The draw string 12 is secured to the first edge 17 of the storage member 14 (see FIG. 4). The first edge 17 can be configured so as to receive the draw string 12. Such configuration can be in the form of a male-female configuration whereby the string 12 is passed through a pocket or tunnel.

The tunnel formed by a folding over of the first edges 17 fabric, with the pocket or tunnel extending the entire length of the first edge 17. Another configuration eliminates folding and sewing of the fabric's edge 17 to form a tunnel, but rather utilizes a plurality of apertures parallel to the fabric's edge 17 to receive the draw string 12 in an interlacing or interwoven arrangement to facilitate constriction.

The draw string 12 is of sufficient length so as to extend beyond both ends 24 of the first edge 17, an amount that allows one to grasp both ends 26 of the draw string 12, wrap the string 12 about a doll's waist 28 and tie a knot 30. The draw string 12 must be of sufficient tensile strength to withstand the weight of the bows 18 within the storage member 14, and the force exerted upon the storage member 14 when a person places the bows 18 within or removes the bows 18 from the storage member 14.

Referring now to FIG. 4, a top elevation view of the device 10 laid flat on a planar surface is depicted. The storage member 14 has a trapezoidal configuration with the first edge 17 and the second edge 19 forming the parallel base lines. The length of the first edge 17 corresponds to the doll's waist 28 dimension. The lengths of the second edge 19 and lateral or entrance sides 34 correspond to the size of the cavity 16 required to store a predetermined quantity of bows 18. It should be noted that the length of the first edge 17 is relatively fixed by the dolls waist dimension; however, the lengths of the second edge 19 may be relatively long and the entrance sides 34 relatively short thereby providing a cavity 16 for a doll with relatively short legs. Conversely, the second edge 19 may be relatively short and the entrance side 34 relatively long by providing the same size cavity 16 as above but for a doll with relatively long legs. It should be further noted that with the longer second edge 19 dimension and shorter entrance side 34 dimension, the resulting hoop characteristic for the doll's skirt, will be larger in diameter than the resulting hoop characteristic provided by a shorter second edge 19 and longer entrance side 34. Thus, with the cavity 16 volume constant, a longer second edge 19 and shorter entrance side 34 will provide a greater hoop skirt diameter for the doll.

The bow storage and hoop substitute device 10 is assembled by first determining the quantity of bows 28 to be stored and deciding how large a diameter a skirt 20 on a doll is to be expanded. Next two-plys of net material having first and second edges 17 and 19, and two entrance sides 34 of predetermined lengths, are sewn together along the first and second edges 17 and 19 thereby forming a tubular configuration and providing access for the bows 28 into the storage cavity 16 via either open entrance side 34. The sewing operation for the first edge 17 may also consider the formation of a draw string pocket or tunnel, discussed supra.

Next, a draw string 12 is interwoven or interlaced with the first edge 17, then tied around the doll's waist 28 and secured via knot 30. Finally, bows 28 are inserted into cavity 18 via either entrance side 34 until the predetermined quantity of bows 18 has expanded the storage member 14 to the desired shape that corresponds to the doll's skirt 20 configuration once the skirt 20 rests upon the expanded storage member 14.

Obviously, many modifications and variations of the present invention are possible in light of the above teachings. Indeed, such a device can be used by the bride, bridesmaids, flowergirls, or other persons associated with a wedding event. Thus it is to be understood that within the scope of the appended claims, the invention may be practiced otherwise than as specifically described above.

What is claimed and desired to be secured by Letters Patent of the United States is:

1. A bow display, storage and hoop substitute device for a skirt comprising: a member fabricated from a quasi-rigid material formed into a configuration with open lateral sides and with a means for attaching said member circumferentially at the midsection of a human form said open lateral sides of said member allowing items to be stored in said member from either lateral side thereby expanding said member to a predetermined expanded position corresponding to an expanded position of said skirt when attached to said human form, said member includes a tubular configuration, said tubular configuration includes a trapezoidal formation when said member is laid flat on a planar surface.

2. The device of claim 1, wherein said material includes a quasi-rigid, two-ply net material.

3. The device of claim 1, wherein said lateral sides are dimensioned to form a cavity of sufficient volume to store a predetermined quantity of bows.

4. The device of claim 1, wherein said member includes a second edge dimensioned to provide a hoop effect having a diameter corresponding to a desired configuration for said skirt.

5. The device of claim 1 wherein said attaching means includes a drawstring received by one edge of said member.

6. The device recited in claim 1 wherein the human form is a doll.

7. A method for constructing a bow display, storage and hoop substitute device for a doll's skirt comprising:

a) supplying a member fabricated from quasi-rigid material formed into configuration with open lateral sides and sized to contain a predetermined quantity of bows and to configure a doll's dress to a predetermined form: and b) providing a means for attaching said member circumferentially at the midsection of a doll, wherein supplying a member includes configuring said member into a tubular design, wherein configuring said member into a tubular design includes configuring said member into a trapezoidal formation when said member is laid flat on a planar surface.

8. The method as recited in claim 7, wherein supplying a material includes selecting a quasi-rigid, two-ply net material.

9. The method of claim 7, wherein providing a means for attaching said member at the midsection of a doll includes interlacing a drawstring with one edge of said member.

10. A bow display, storage and hoop substitute device for a doll's skirt comprising: a member fabricated from a quasi-rigid material formed into a configuration with open lateral sides and with a means for attaching said member circumferentially at the midsection of a doll, said open lateral sides of said member allowing items to be stored in said member from either lateral side thereby expanding said member to a predetermined expanded position corresponding to an expanded position of said skirt when attached to said doll, said member includes a tubular configuration, said tubular configuration includes a trapezoidal formation when said member is laid flat on a planar surface.

11. The device of claim 10, wherein said material includes a quasi-rigid, two-ply net material.

12. The device of claim 10, wherein said lateral sides are dimensioned to form a cavity of sufficient volume to store a predetermined quantity of bows.

13. The device of claim 10, wherein said member includes a second edge dimensioned to provide a hoop effect having a diameter corresponding to a desired configuration for said doll's skirt.

14. The device of claim 10, wherein said attaching means includes a drawstring received by one edge of said member.

15. A bow display, storage and hoop substitute device for a skirt comprising:

a member fabricated from a material formed into a configuration with open lateral sides and with a means for attaching said member circumferentially at the midsection of a human form such that said open lateral sides of said member are unrestricted by said attaching means thereby allowing items to be stored in said member from either lateral side while said member is attached to said human form thereby expanding said member to a predetermined expanded position corresponding to an expanded position of said skirt when attached to said human form, said member includes a tubular configuration, said tubular configuration includes a trapezoidal formation when said member is laid flat on a planar surface.

16. A method of constructing a bow display, storage and hoop substitute device for a doll's skirt comprising:

a) supplying a member fabricated from material formed into a configuration with open lateral sides and sized to contain a predetermined quantity of bows and to configure a doll's dress to a predetermined form; and b) providing a means for attaching said member circumferentially at the midsection of a doll such that said open lateral sides of said member are unrestricted by said attaching means thereby allowing said bows to be stored in said member from either lateral side while said member is attached to said doll, wherein supplying a member includes configuring said member into a tubular design;

wherein configuring said member into a tubular design includes configuring said member into a trapezoidal formation when said member is laid flat on a planar surface.

17. A bow display, storage and hoop substitute device for a doll's skirt comprising:

a member fabricated from a material formed into a configuration with open lateral sides and with a means for attaching said member circumferentially at the midsection of a doll such that said open lateral sides of said member are unrestricted by said attaching means thereby allowing items to be stored in said member from either lateral side while said member is attached to said doll thereby expanding said member to a predetermined expanded position corresponding to an expanded position of said skirt when attached to said doll, said member includes a tubular configuration, said tubular configuration includes a trapezoidal formation when said member is laid flat on a planar surface.

* * * * *